US011358776B1

(12) United States Patent
Parella et al.

(10) Patent No.: US 11,358,776 B1
(45) Date of Patent: Jun. 14, 2022

(54) BRACE ELEMENT AND CORNER POST ASSEMBLY

(71) Applicant: RATIONAL PACKAGING LLC, Springfield, TN (US)

(72) Inventors: Shawn M. Parella, Greenbrier, TN (US); Samuel C. Voorhees, Louisville, KY (US)

(73) Assignee: RATIONAL PACKAGING LLC, Springfield, TN (US)

( * ) Notice: Subject to any disclaimer, the term of this patent is extended or adjusted under 35 U.S.C. 154(b) by 0 days.

(21) Appl. No.: 17/088,142

(22) Filed: Nov. 3, 2020

Related U.S. Application Data

(63) Continuation-in-part of application No. 15/964,439, filed on Apr. 27, 2018, now Pat. No. 10,822,138, and a continuation-in-part of application No. 29/726,544, filed on Mar. 4, 2020, and a continuation-in-part of application No. 29/726,541, filed on Mar. 4, 2020, and a continuation-in-part of application No. 16/244,676, filed on Jan. 10, 2019, now Pat. No. 10,899,524, which is a continuation-in-part of application No. 29/667,161, filed on Oct. 18, 2018, now Pat. No. Des. 908,003, application No. 17/088,142, which is a continuation-in-part of application No. 29/667,161, filed on Oct. 18, 2018, now Pat. No. Des. 908,003, which is a continuation-in-part of application No. 29/593,147, filed on Feb. 6, 2017, now Pat. No. Des. 871,908, and a continuation-in-part of application No. 29/593,144, filed on Feb. 6, 2017, now Pat. No. Des. 871,213.

(51) Int. Cl.
*B65D 81/05* (2006.01)

(52) U.S. Cl.
CPC ..... *B65D 81/056* (2013.01); *B65D 81/054* (2013.01)

(58) Field of Classification Search
CPC .. B65D 81/056; B65D 81/054; B65D 81/053; B65D 81/05
USPC ..... 206/586, 521
See application file for complete search history.

(56) References Cited

U.S. PATENT DOCUMENTS 4,244,471 A * 1/1981 Plante ..... B65D 19/0018 206/386
4,482,054 A * 11/1984 Gardner ..... B65D 81/05 206/320
5,267,651 A * 12/1993 Hughes ..... B65D 5/5033 206/453

(Continued)

*Primary Examiner* — Steven A. Reynolds
(74) *Attorney, Agent, or Firm* — Shaddock Law Group, PC

(57) ABSTRACT

A corner post assembly including at least a corrugated corner post, having a portion of material having a post vertex; a first corner post leg having one or more alternating post ridges and post grooves and extending from the post vertex; a second corner post leg having one or more alternating post ridges and post grooves and extending from the post vertex; a brace element, having a portion of material having a brace vertex; a first brace leg having one or more alternating brace ridges and brace grooves extending from the brace vertex; a second brace leg having one or more alternating brace ridges and brace grooves extending from the brace vertex and having one or more alternating brace end ridges and brace end grooves formed in a first brace terminal end and a second brace terminal end of the first brace leg and the second brace leg.

20 Claims, 14 Drawing Sheets

(56) References Cited

U.S. PATENT DOCUMENTS

| | | | | | |
|---|---|---|---|---|---|
| 5,307,928 | A * | 5/1994 | Bishop | B65D 5/5033 | 206/320 |
| 5,918,800 | A * | 7/1999 | Goshorn | B60P 7/0869 | 229/199 |
| 6,059,104 | A * | 5/2000 | Widman | B65D 81/054 | 206/320 |
| 6,513,662 | B1 * | 2/2003 | Stebelton | B65D 81/054 | 206/586 |
| 7,048,118 | B2 * | 5/2006 | Baechle | B65D 61/00 | 206/320 |
| 8,079,476 | B2 * | 12/2011 | Simms | B65D 81/054 | 206/586 |
| 2005/0092633 | A1 * | 5/2005 | Baechle | B65D 61/00 | 206/320 |
| 2010/0187153 | A1 * | 7/2010 | Simms | B65D 81/054 | 206/586 |

* cited by examiner

BRACE ELEMENT AND CORNER POST ASSEMBLY

CROSS-REFERENCE TO RELATED APPLICATIONS

This patent application is a continuation-in-part of U.S. patent application Ser. No. 15/964,439, filed Apr. 27, 2018, and is a continuation-in-part of U.S. patent application Ser. No. 29/726,544, filed Mar. 4, 2020, and is a continuation-in-part of U.S. patent application Ser. No. 29/726,541, filed Mar. 4, 2020, and is a continuation-in-part of U.S. patent application Ser. No. 16/244,676, filed Jan. 10, 2019, which is a continuation-in-part of U.S. patent application Ser. No. 29/667,161, filed Oct. 18, 2018, and which is a continuation-in-part of U.S. patent application Ser. No. 29/593,144, filed Feb. 6, 2017, and is a continuation-in-part of U.S. patent application Ser. No. 29/667,161, filed Oct. 18, 2018, which is a continuation-in-part of U.S. patent application Ser. No. 29/593,147, filed Feb. 6, 2017, the disclosures of which are incorporated herein in their entireties by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging assemblies. More specifically, the present disclosure relates to corrugated corner posts and a corrugated, brace element.

2. Description of Related Art

It is generally known to use various packaging assemblies to package products for storage or shipping. Typically, packaging assemblies are constructed so as to stabilize the contained item or items and provide a certain degree of cushioning against breakage, while being moved or transported.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging assemblies and assembly components have various shortcomings. Among other things, known packaging assemblies and/or assembly components are cumbersome and have shapes that are not conducive to being packaged for shipment prior to assembly. Thus, shipping certain of the assembly components can be inefficient.

Additionally, known packaging assemblies fail to provide efficient alignment of components to create the packaging assembly.

In contrast, the present disclosure provides a brace element that can be aligned with corrugated packaging corner posts. The brace element includes scalloped end portions that allow brace ridges and brace grooves of the brace element to be aligned at least partially within post grooves and post ridges, respectively, of the corrugated corner posts. This provides for more surface contact between the brace element and the corrugated corner posts.

Additionally, an optional brace score mark may be included along a portion of the brace element to allow one of the brace element legs of the brace element to be more easily bent or folded so that the post ridges and/or post grooves of the corner post legs can be more easily or appropriately aligned with the brace grooves and/or brace ridges of the brace element.

In addition to allowing the brace element to be more easily aligned within the corrugated corner posts, the at least one brace score mark provides a line or portion along which the brace element may be bent or folded. By bending or folding the brace element along the brace score mark, a portion of the brace element can be urged from the formed position to a more flattened position. By providing the brace element in a more flattened position, the amount of space occupied by the brace element can be reduced and a greater number of brace elements can be packaged within a given shipment package.

Similarly, at least one post score mark formed in a portion of each corner post provides a line or portion along which the corner post may be bent or folded. By bending or folding the corner post along the post score mark, a portion of the corner post can be urged from the formed position to a more flattened position. By providing the corner post in a more flattened position, the amount of space occupied by the corner post can be reduced and a greater number of corner posts can be packaged within a given shipment package.

In various exemplary, non-limiting embodiments, the brace element and corner post assembly of the present disclosure include at least some of a corrugated corner post, comprising a portion of material extending continuously, substantially parallel to a longitudinal axis of the corrugated corner post, from a first post terminal end to a second post terminal end, wherein the portion of material extends continuously, substantially perpendicular to the longitudinal axis of the corrugated corner post, from a first corner post end to a second corner post end; a post vertex extending substantially parallel to the longitudinal axis of the corrugated corner post; a first corner post leg, extending laterally from the post vertex, the first corner post leg having one or more alternating post ridges and post grooves, each of the alternating post ridges and post grooves of the first corner post leg extending substantially parallel to the longitudinal axis of the corrugated corner post; a second corner post leg, extending laterally from the post vertex and away from the first corner post leg, the second corner post leg having one or more alternating post ridges and post grooves, each of the alternating post ridges and post grooves of the second corner post leg extending substantially parallel to the longitudinal axis of the corrugated corner post; a post score mark formed in the corrugated corner post, extending substantially parallel to the longitudinal axis of the corrugated corner post, wherein the post score mark provides a line or portion along which the corrugated corner post may be bent or folded such that the corrugated corner post may be more easily manipulated to a more flattened position a brace element, comprising a portion of material extending continuously, substantially parallel to a longitudinal axis of the brace element, from a first brace terminal end to a second brace terminal end, wherein the portion of material extends continuously, substantially perpendicular to the longitudinal axis of the brace element, from a first brace end to a second brace end; a brace vertex extending substantially parallel to the longitudinal axis of the brace element; a first brace leg, extending laterally from the brace vertex, the first brace leg having one or more alternating brace ridges and brace grooves, each of the alternating brace ridges and brace grooves of the first brace leg extending substantially parallel to the longitudinal axis of the brace element; a second brace leg, extending laterally from the brace vertex and away from the first brace leg, the second brace leg having one or more alternating brace ridges and brace grooves, each of the alternating brace ridges and brace grooves of the second brace leg extending substantially parallel to the longitudinal axis of the brace element; one or more alternating brace end ridges and brace end grooves formed in the first brace terminal end and the second brace terminal end of the first brace leg and the second brace leg; and a brace score mark formed in the brace element, extending substantially parallel to the longitudinal axis of the brace element, wherein the brace score mark provides a line or portion along which the brace element may be bent or folded such that the brace element may be more easily manipulated to a more flattened position; wherein two corrugated corner posts are aligned and a brace element is positioned between the aligned corrugated corner posts, such that at least a portion of each of the brace end ridges of the first brace leg is positioned within at least a portion of a corresponding post ridge and at least a portion of a post groove is positioned within at least a portion of a corresponding brace groove, and wherein at least a portion of each of the brace end ridges of the second brace leg is positioned within at least a portion of a corresponding post ridge and at least a portion of a post groove is positioned within at least a portion of a corresponding brace groove.

In various other exemplary, non-limiting embodiments, the portion of material is a sheet material.

In various other exemplary, non-limiting embodiments, the post score mark is formed proximate a center of the corrugated corner post, as defined between the first corner post end and the second corner post end.

In various other exemplary, non-limiting embodiments, the post score mark is formed proximate the first corner post end or the second corner post end.

In various other exemplary, non-limiting embodiments, an outer wall of the corrugated corner post is substantially coextensive with an inner wall of the corrugated corner post.

In various other exemplary, non-limiting embodiments, each of the alternating post ridges and post grooves of the first corner post leg are alternating post ridges and post grooves, extending substantially parallel to the post vertex and wherein each of the alternating post ridges and post grooves of the second corner post leg are alternating post ridges and post grooves, extending substantially parallel to the post vertex.

In various other exemplary, non-limiting embodiments, the first corner post leg and the second corner post leg are each curvilinear along a respective length.

In various other exemplary, non-limiting embodiments, a transverse cross-section of the first corner post leg forms a mirror image of a transverse cross-section of the second corner post leg.

In various other exemplary, non-limiting embodiments, the post score mark is formed in a portion of an outer wall or exterior surface of the portion of material.

In various other exemplary, non-limiting embodiments, the brace score mark is formed proximate a center of the brace, as defined between the first brace end and the second brace end.

In various other exemplary, non-limiting embodiments, the brace score mark is formed proximate the first brace end or the second brace end.

In various other exemplary, non-limiting embodiments, an outer wall of the brace is substantially coextensive with an inner wall of the brace.

In various other exemplary, non-limiting embodiments, each of the alternating brace ridges and brace grooves of the first brace leg are alternating brace ridges and brace grooves, extending substantially parallel to the brace vertex and wherein each of the alternating brace ridges and brace grooves of the second brace leg are alternating brace ridges and brace grooves, extending substantially parallel to the brace vertex.

In various other exemplary, non-limiting embodiments, the first brace leg and the second brace leg are each curvilinear along a respective length.

In various other exemplary, non-limiting embodiments, an inner wall of the first brace leg and an inner wall of the second brace leg comprises a sinusoidal succession of waves or curves.

In various other exemplary, non-limiting embodiments, a transverse cross-section of the first brace leg forms a mirror image of a transverse cross-section of the second brace leg.

In various other exemplary, non-limiting embodiments, the brace score mark is formed in a portion of an outer wall or exterior surface of the portion of material.

In various exemplary, non-limiting embodiments, the brace element and corner post assembly of the present disclosure include at least some of a corrugated corner post, comprising a portion of material extending continuously, substantially parallel to a longitudinal axis of the corrugated corner post, from a first post terminal end to a second post terminal end, wherein the portion of material extends continuously, substantially perpendicular to the longitudinal axis of the corrugated corner post, from a first corner post end to a second corner post end; a post vertex extending substantially parallel to the longitudinal axis of the corrugated corner post; a first corner post leg, extending laterally from the post vertex, the first corner post leg having one or more alternating post ridges and post grooves, each of the alternating post ridges and post grooves of the first corner post leg extending substantially parallel to the longitudinal axis of the corrugated corner post; a second corner post leg, extending laterally from the post vertex and away from the first corner post leg, the second corner post leg having one or more alternating post ridges and post grooves, each of the alternating post ridges and post grooves of the second corner post leg extending substantially parallel to the longitudinal axis of the corrugated corner post; a brace element, comprising: a portion of material extending continuously, substantially parallel to a longitudinal axis of the brace element, from a first brace terminal end to a second brace terminal end, wherein the portion of material extends continuously, substantially perpendicular to the longitudinal axis of the brace element, from a first brace end to a second brace end; a brace vertex extending substantially parallel to the longitudinal axis of the brace element; a first brace leg, extending laterally from the brace vertex, the first brace leg having one or more alternating brace ridges and brace grooves, each of the alternating brace ridges and brace grooves of the first brace leg extending substantially parallel to the longitudinal axis of the brace element; a second brace leg, extending laterally from the brace vertex and away from the first brace leg, the second brace leg having one or more alternating brace ridges and brace grooves, each of the alternating brace ridges and brace grooves of the second brace leg extending substantially parallel to the longitudinal axis of the brace element; and one or more alternating brace end ridges and brace end grooves formed in the first brace terminal end and the second brace terminal end of the first brace leg and the second brace leg; wherein two corrugated corner posts are aligned and a brace element is positioned between the aligned corrugated corner posts, such that at least a portion of each of the brace end ridges of the first brace leg is positioned within at least a portion of a corresponding post ridge and at least a portion of a post groove is positioned within at least a portion of a corresponding brace groove, and wherein at least a portion of each of the brace end ridges of the second brace leg is positioned within at least a portion of a corresponding post ridge and at least a portion of a post groove is positioned within at least a portion of a corresponding brace groove.

In various exemplary, non-limiting embodiments, the brace element and corner post assembly of the present disclosure include at least some of a corrugated corner post, comprising a portion of material extending from a first post terminal end to a second post terminal end, wherein the portion of material extends continuously, substantially perpendicular to a longitudinal axis of the corrugated corner post, from a first corner post end to a second corner post end; a post vertex extending substantially parallel to the longitudinal axis of the corrugated corner post; a first corner post leg, extending from the post vertex, the first corner post leg having one or more alternating post ridges and post grooves, each of the alternating post ridges and post grooves of the first corner post leg extending substantially parallel to the longitudinal axis of the corrugated corner post; a second corner post leg, extending from the post vertex, away from the first corner post leg, the second corner post leg having one or more alternating post ridges and post grooves, each of the alternating post ridges and post grooves of the second corner post leg extending substantially parallel to the longitudinal axis of the corrugated corner post; a brace element, comprising: a portion of material extending from a first brace terminal end to a second brace terminal end, wherein the portion of material extends continuously, substantially perpendicular to a longitudinal axis of the brace element, from a first brace end to a second brace end; a brace vertex extending substantially parallel to the longitudinal axis of the brace element; a first brace leg, extending from the brace vertex, the first brace leg having one or more alternating brace ridges and brace grooves, each of the alternating brace ridges and brace grooves of the first brace leg extending substantially parallel to the longitudinal axis of the brace element; a second brace leg, extending from the brace vertex, away from the first brace leg, the second brace leg having one or more alternating brace ridges and brace grooves, each of the alternating brace ridges and brace grooves of the second brace leg extending substantially parallel to the longitudinal axis of the brace element; and one or more alternating brace end ridges and brace end grooves formed in the first brace terminal end and the second brace terminal end of the first brace leg and the second brace leg.

In various other exemplary, non-limiting embodiments, two corrugated corner posts are aligned and a brace element is positioned between the aligned corrugated corner posts, such that at least a portion of each of the brace end ridges of the first brace leg is positioned within at least a portion of a corresponding post ridge and at least a portion of a post groove is positioned within at least a portion of a corresponding brace groove, and wherein at least a portion of each of the brace end ridges of the second brace leg is positioned within at least a portion of a corresponding post ridge and at least a portion of a post groove is positioned within at least a portion of a corresponding brace groove.

Accordingly, the present disclosure separately and optionally provides brace element and/or corner post that can be bent or folded along a longitudinal axis, substantially parallel to a series of alternating post ridges and post grooves, allowing the brace element and or corner post to be presented in a more flattened configuration for storage or shipping.

The present disclosure separately and optionally provides brace element and corner post assembly that can be easily stored in a relatively compact configuration, awaiting assembly and use.

The present disclosure separately and optionally provides brace element and corner post assembly that can be easily assembled or constructed, when needed.

The present disclosure separately and optionally provides brace element and corner post assembly that provides lower costs for handling and storage.

The present disclosure separately and optionally provides brace element and corner post assembly with a high degree of compressional strength.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
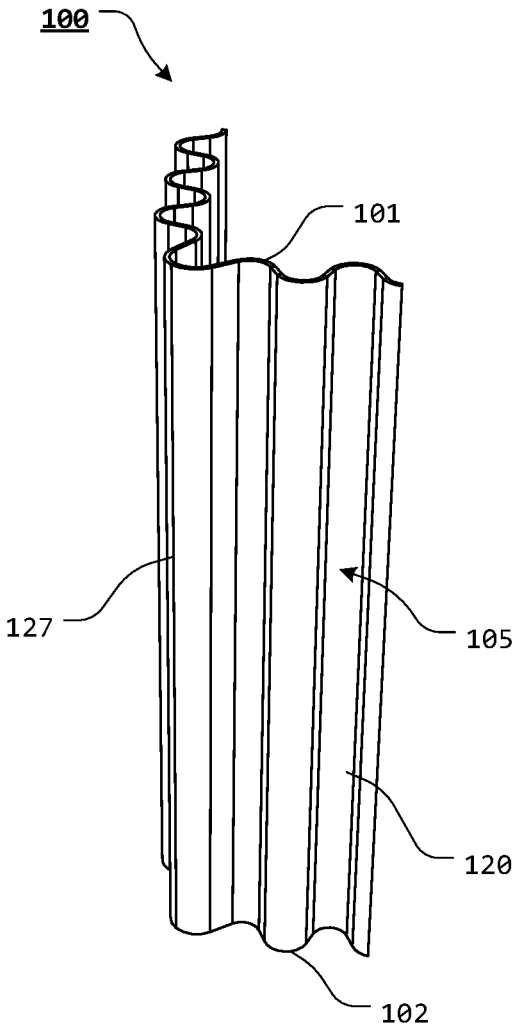
FIG. 1 illustrates a top, left, rear, perspective view of an exemplary embodiment of a corrugated corner post, according to the present disclosure.
Figure 2:
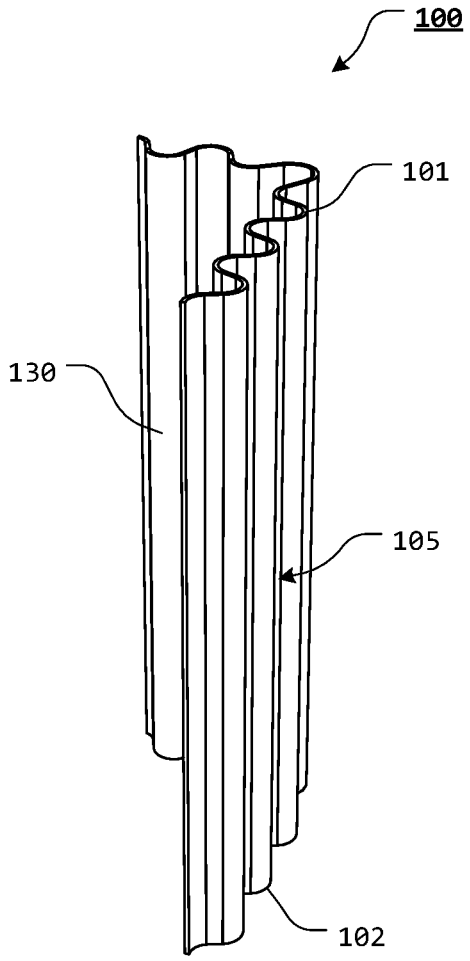
FIG. 2 illustrates a top, right, rear, perspective of an exemplary embodiment of a corrugated corner post, according to the present disclosure.
Figure 3:
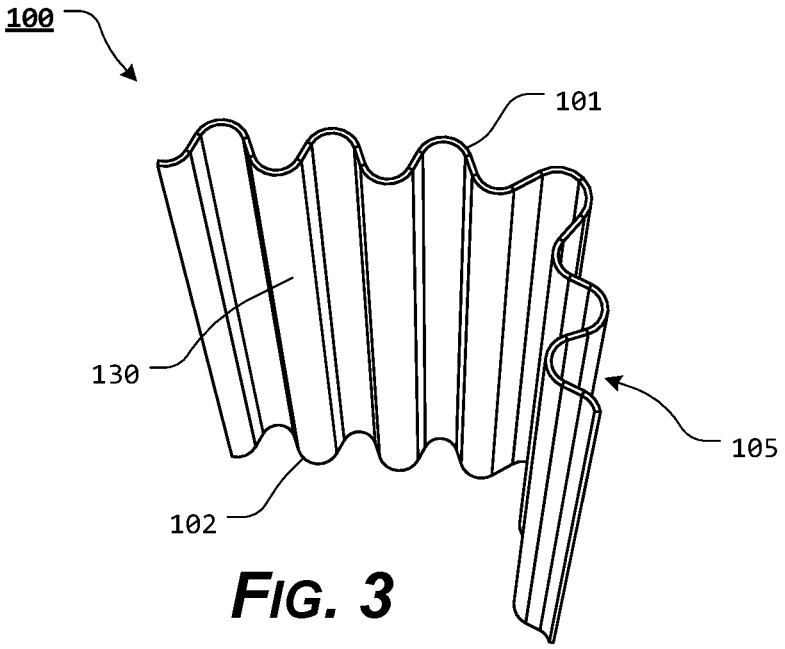
FIG. 3 illustrates a bottom, left, front, perspective of an exemplary embodiment of a corrugated corner post, according to the present disclosure, the front view of the exemplary embodiment of the corrugated corner post is a mirror image of the front view.
Figure 4:
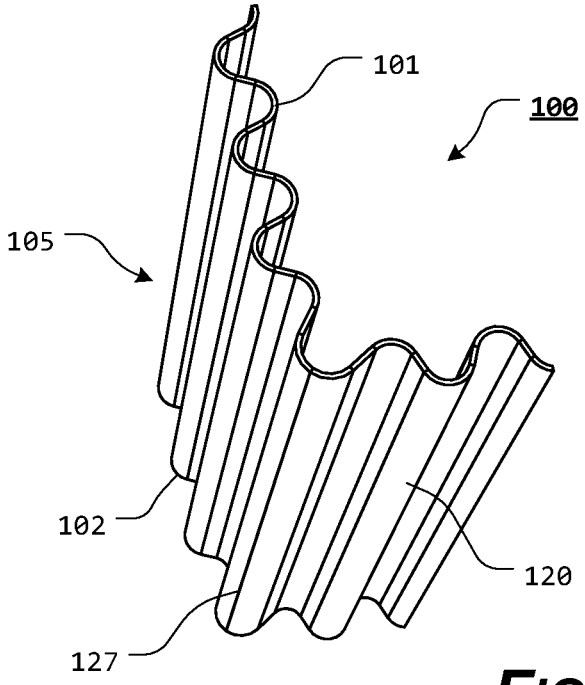
FIG. 4 illustrates a top, left, rear, perspective view of an exemplary embodiment of a corrugated corner post, according to the present disclosure.
Figure 5:
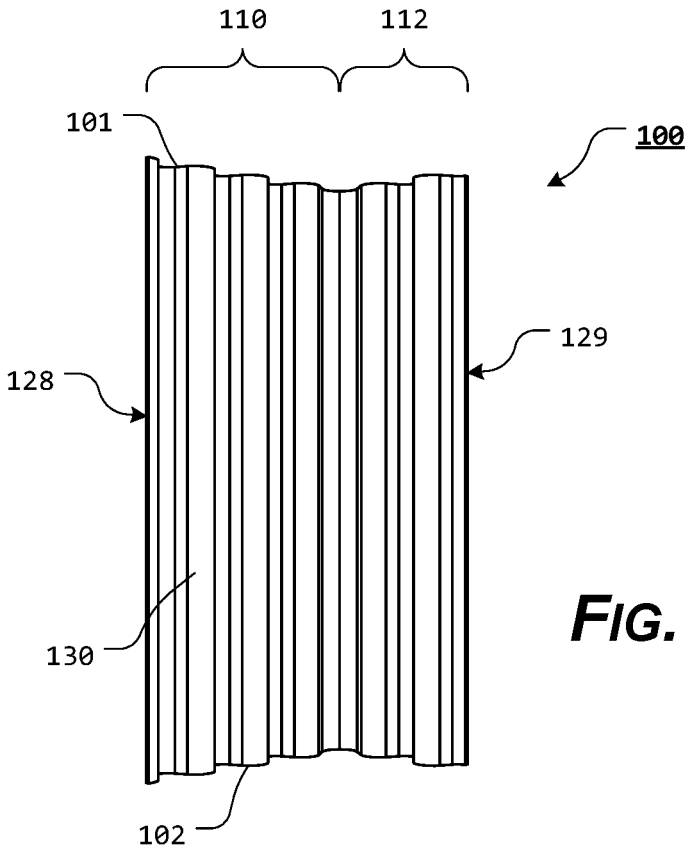
FIG. 5 illustrates a front, perspective view of an exemplary embodiment of a corrugated corner post, according to the present disclosure.
Figure 6:
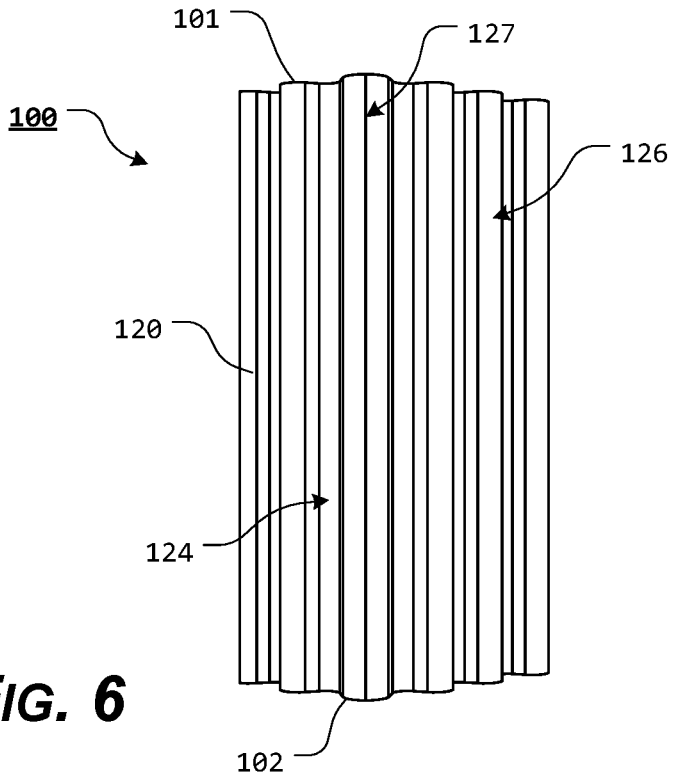
FIG. 6 illustrates a rear, perspective view of an exemplary embodiment of a corrugated corner post, wherein the corrugated corner post is in a formed position, according to the present disclosure.

For simplicity and clarification, the design factors and operating principles of the brace element and corner post assembly are explained with reference to various exemplary embodiments of brace element and corner post assembly according to the present disclosure. The basic explanation of the design factors and operating principles of the brace element and corner post assembly is applicable for the understanding, design, and operation of the brace element and corner post assembly of the present disclosure. It should be appreciated that the brace element and corner post assembly can be adapted to many applications where a packaging assembly can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "corner post", "corrugated corner post", "brace element", and "brace" are used for basic explanation and understanding of the operation of the systems, methods, and apparatuses of the present disclosure. Therefore, the terms "corner post", "corrugated corner post", "brace element", and "brace" are not to be construed as limiting the systems, methods, and apparatuses of the present disclosure.

As used herein, the longitudinal axis, $A_L$, is the long axis of an object or structure, running the length of the object or structure (i.e., between the first post terminal end 101 and the second post terminal end 102), while the transverse axis, $A_T$, extends substantially perpendicular to the longitudinal axis, $A_L$ (i.e., between the first corner post end 128 and the second corner post end 129).

Turning now to the appended drawing figures, FIGS. 1-10 illustrate certain elements and/or aspects of exemplary embodiments of a corrugated corner post 100, according to the present disclosure. FIGS. 11-20 illustrate certain elements and/or aspects of exemplary embodiments of a brace element 200, according to the present disclosure. FIGS. 21-30 illustrate certain elements and/or aspects of exemplary embodiments of a brace element and corner post assembly 300, according to the present disclosure.

As illustrated most clearly in FIGS. 1-10, the corrugated corner post 100 optionally comprises an elongate portion of material or a sheet 105 that extends, substantially parallel to a longitudinal axis, $A_L$, from a first post terminal end 101 to a second post terminal end 102. In various exemplary embodiments, the corrugated corner post 100 extends continuously, in an uninterrupted manner, from the first post terminal end 101 to the second post terminal end 102. Alternatively, one or more notches, recesses, or depressions may optionally be formed in one or more areas, along the corrugated corner post 100, between the first post terminal end 101 and the second post terminal end 102.

The portion of material or sheet 105 also extends continuously, extending substantially parallel to a transverse axis, $A_T$, from a first corner post end 128 to a second corner post end 129.

In various exemplary embodiments, the corrugated corner post 100 is formed of a portion of material or a sheet 105. In certain exemplary embodiments, the material used to form the sheet 105 comprises a single layer of material. Alternatively, the material used to form sheet 105 comprises multiple layers of similar or dissimilar materials joined or adhesively bonded together to form the sheet 105. Thus, it should be appreciated that the sheet 105 may comprise a single layer of material or may be a multi-layer sheet 105 formed of a laminate of a plurality of layers of material attached or coupled by an adhesive or other means.

The sheet 105 may also be formed of paperboard, chipboard, container board, box board, cardboard, or corrugated fiberboard.

A post vertex 122 is defined along the corrugated corner post 100. The post vertex 122 generally extends, extending substantially parallel to the longitudinal axis, $A_L$, from the first post terminal end 101 to the second post terminal end 102. The post vertex 122 defines a line from which the first corner post leg 110 and the second corner post leg 112 extend. In certain exemplary, non-limiting embodiments, the post vertex 122 bisects the corrugated corner post 100, extending substantially parallel to the longitudinal axis, $A_L$, proximate a center of each of the corrugated corner post 100. Generally, the post vertex 122 defines the furthest extent of the first corner post end 128 and the second corner post end 129.

The first corner post leg 110 extends continuously, laterally from the post vertex 122 to a first corner post end 128, while the second corner post leg 112 extends laterally from the post vertex 122 to a second corner post end 129. The second corner post end 129 extends laterally from the post vertex 122, in a direction that is generally away from the direction that the first corner post end 128 extends laterally from the post vertex 122.

In certain exemplary, nonlimiting embodiments, substantially straight lines from the post vertex 122 to the respective first corner post end 128 and from the post vertex 122 to the second corner post end 129 are at approximately 90° relative to one another.

Figure 7:
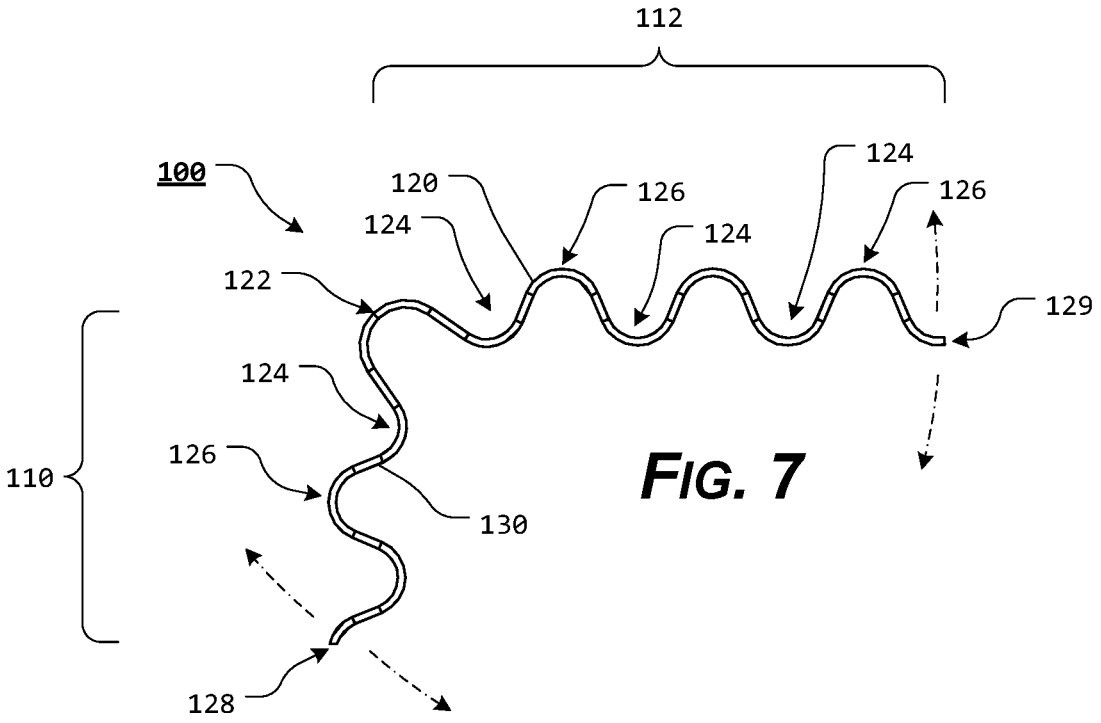
FIG. 7 illustrates a top view of an exemplary embodiment of a corrugated corner post, according to the present disclosure.
Figure 8:
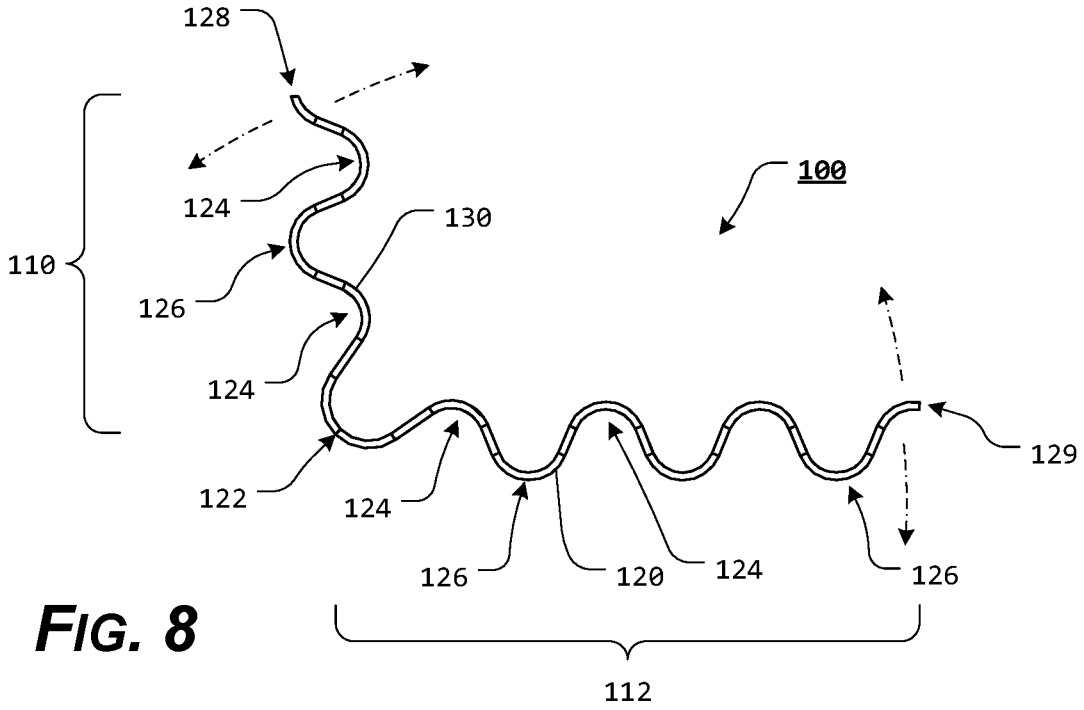
FIG. 8 illustrates a bottom view of an exemplary embodiment of a corrugated corner post, according to the present disclosure.

Typically, when viewed from the top or the bottom, as illustrated in FIGS. 7 and 8, respectively, the first corner post leg 110 includes one or more alternating post ridges 126 and post grooves 124, formed along its length. Likewise, the second corner post leg 112 includes one or more alternating post ridges 126 and/or post grooves 124, along its length. Each of the alternating post ridges 126 and post grooves 124 of the first corner post leg 110 extends, extending substantially parallel to or extending substantially parallel to the longitudinal axis, $A_L$, of the corrugated corner post 100. In certain exemplary, nonlimiting embodiments, each of the alternating post ridges 126 and post grooves 124 are extending substantially parallel and alternating post ridges 126 and post grooves 124.

By including the alternating post ridges 126 and post grooves 124, the first corner post leg 110 and the second corner post leg 112 is curvilinear along its respective length, from the post vertex 122 to the respective first corner post end 128 and from the post vertex 122 to the second corner post end 129. The alternating post ridges 126 and post grooves 124 may be formed such that the first corner post leg 110 and the second corner post leg 112 each comprise a sinusoidal succession of waves or curves, along the respective lengths, from the post vertex 122 to the respective first corner post end 128 and from the post vertex 122 to the second corner post end 129.

As illustrated, a transverse cross-section of the corrugated corner post 100 demonstrates that the second corner post leg 112 includes more alternating post ridges 126 and post grooves 124 than the first corner post leg 110. However, it should be appreciated that the corrugated corner post 100 is not so limited and the second corner post leg 112 may optionally include fewer alternating post ridges 126 and post grooves 124 than the first corner post leg 110. Furthermore, the second corner post leg 112 may optionally include the same number of alternating post ridges 126 and post grooves 124 as the first corner post leg 110. Thus, a transverse cross-section of the second corner post leg 112 may have alternating post ridges 126 and post grooves 124 that are mirror images of the alternating post ridges 126 and post grooves 124 of a transverse cross-section of the first corner post leg 110.

It should also be understood that the number of alternating post ridges 126 and post grooves 124 formed in either the first corner post leg 110 or the second corner post leg 112 is a design choice based upon the desired number of alternating post ridges 126 and post grooves 124 and/or length of the first corner post leg 110 or the second corner post leg 112.

A post outer wall 120 forms an exterior surface of the corrugated corner post 100, while an post inner wall 130 forms and interior surface of the corrugated corner post 100. As used herein, the terms "outer", "exterior", "inner", and "interior" are used for reference only and are not to be viewed as limiting the present disclosure. In certain exemplary, non-limiting embodiments, the post outer wall 120 of the corrugated corner post 100 is substantially coextensive with the post inner wall 130 of the corrugated corner post 100.

Because of the inclusion of the alternating post ridges 126 and post grooves 124, the corrugated corner post 100 is even better able to resist left to right compression, extending substantially parallel to the longitudinal axis, $A_L$, of the corrugated corner post 100. Additionally, the inclusion of the alternating post ridges 126 and post grooves 124 help each of the first corner post leg 110 and second corner post leg 112 to better resist crushing, when forces are applied to the post outer wall 120 and/or the post inner wall 130.

At least the post vertex 122 and possibly the alternating post ridges 126 and post grooves 124 allow for a degree of inward flexion and resilient recovery toward the original shape of the first corner post leg 110 relative to the second corner post leg 112, as illustrated by the arrows in FIGS. 7 and 8.

The structure or grain of the corrugated corner post 100 or the sheet 105 may make it difficult to create an even bend or fold along a portion of the corrugated corner post 100 or the sheet 105. Providing a post score mark 127 allows the material of the corrugated corner post 100 or the sheet 105 to form or more easily form a bend or fold or more easily form an even or consistent bend or fold.

In certain exemplary, nonlimiting embodiments, a post score mark 127, formed of a complete or partial recess or depression in the portion of material or sheet 105 or formed of a complete or partial perforation formed in the portion of material or sheet 105 extending substantially parallel to or extending substantially parallel to the longitudinal axis, $A_L$, of the corrugated corner post 100.

In various exemplary embodiments, the post score mark 127 may be formed of a compressed area of the corrugated corner post 100, without creating a cut. Alternatively, the post score mark 127 may be formed of a partial cut through the portion of material or sheet 105.

In certain exemplary embodiments, the post score mark 127 is formed in a portion of the post outer wall 120 or exterior surface of the corrugated corner post 100. Alternatively, the post score mark 127 may optionally be formed in a portion of the post inner wall 130 or interior surface of the corrugated corner post 100.

In certain exemplary embodiments, the post score mark 127 extends from the first post terminal end 101 to the second post terminal end 102. Alternatively, the post score mark 127 may extend from an area proximate the first post terminal end 101 to an area proximate the second post terminal end 102.

The post score mark 127 provides a line or portion along which the corrugated corner post 100 may be comparatively more easily bent or folded, whether along the grain or against the grain of the corrugated corner post 100 or the sheet 105. Thus, the post score mark 127 may optionally provide a compressed or weakened area or portion of the corrugated corner post 100, along which the corrugated corner post 100 may be comparatively more easily bent or folded.

Figure 9:
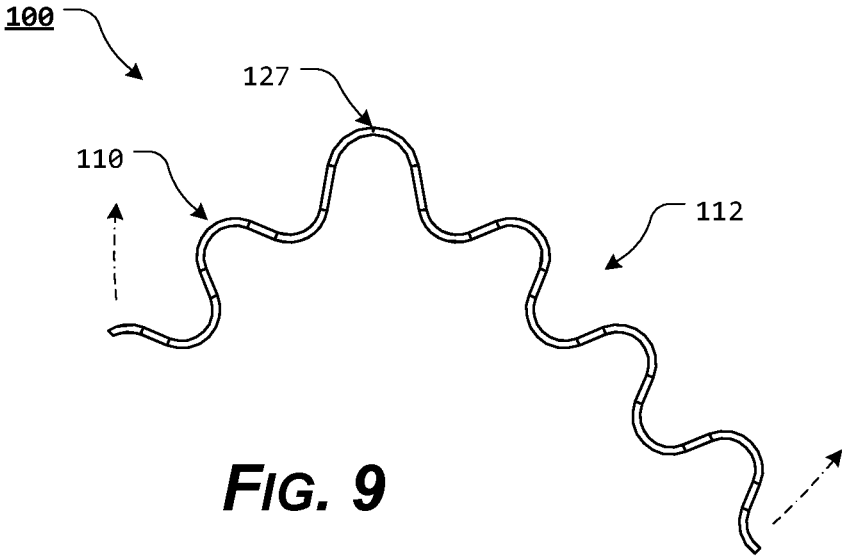
FIG. 9 illustrates a top view of an exemplary embodiment of a corrugated corner post, wherein the corrugated corner post is in a formed position, according to the present disclosure.
Figure 10:
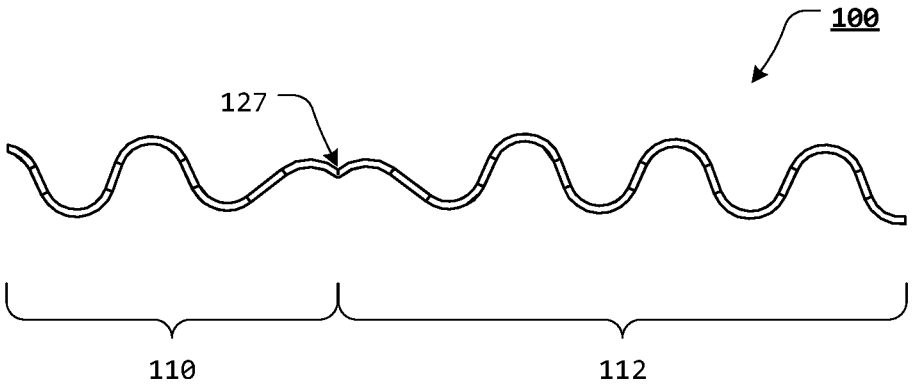
FIG. 10 illustrates a top view of an exemplary embodiment of a corrugated corner post, wherein the corrugated corner post is in a more flattened position, according to the present disclosure.
Figure 11:
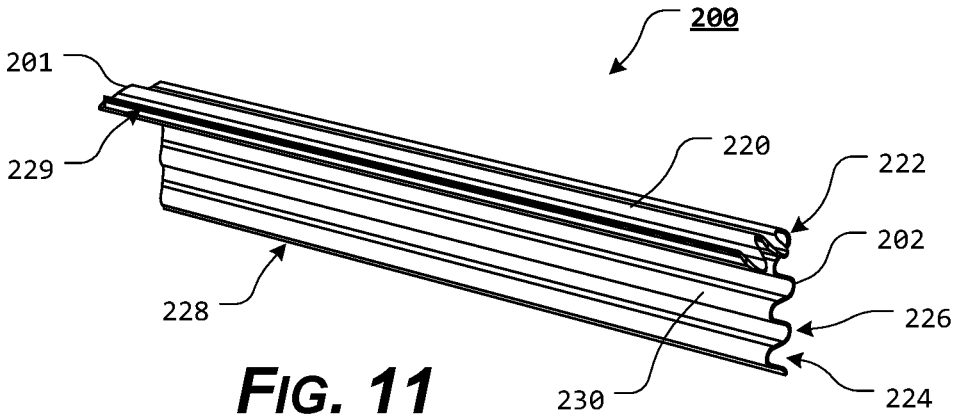
FIG. 11 illustrates a front, left, perspective view of an exemplary embodiment of a brace element, according to the present disclosure.
Figure 12:
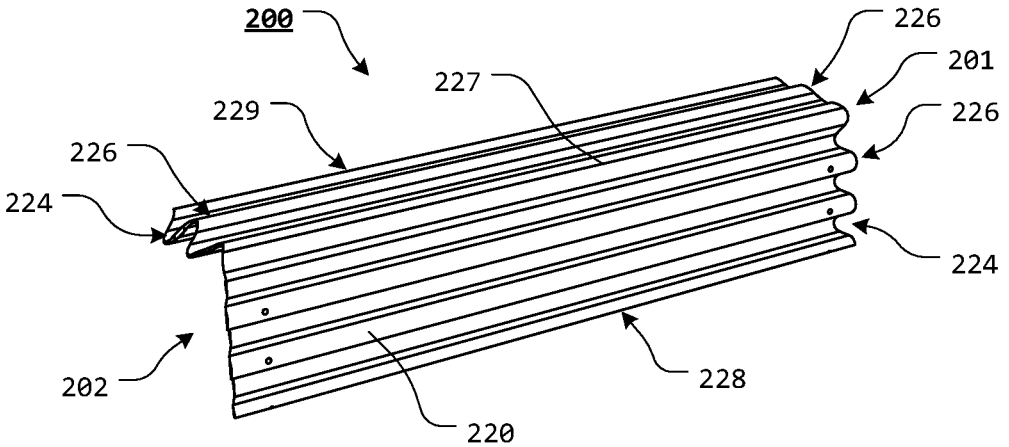
FIG. 12 illustrates a rear, perspective view of an exemplary embodiment of a brace element, according to the present disclosure.
Figure 13:
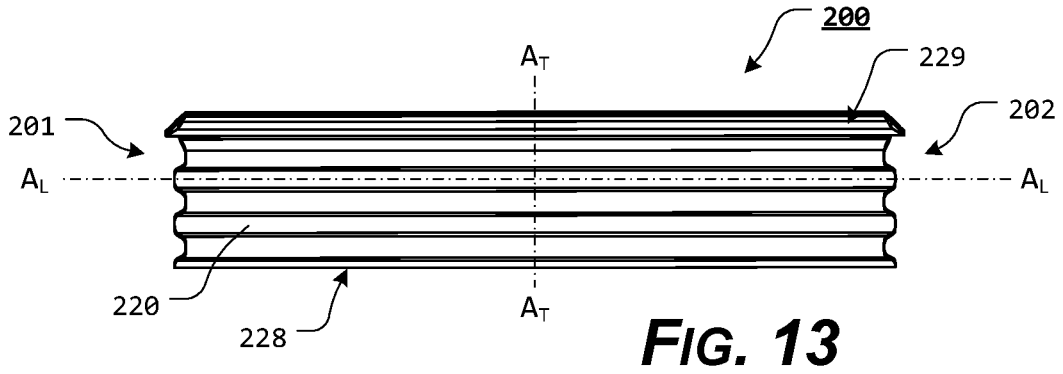
FIG. 13 illustrates a front view of an exemplary embodiment of a brace element, according to the present disclosure.
Figure 14:
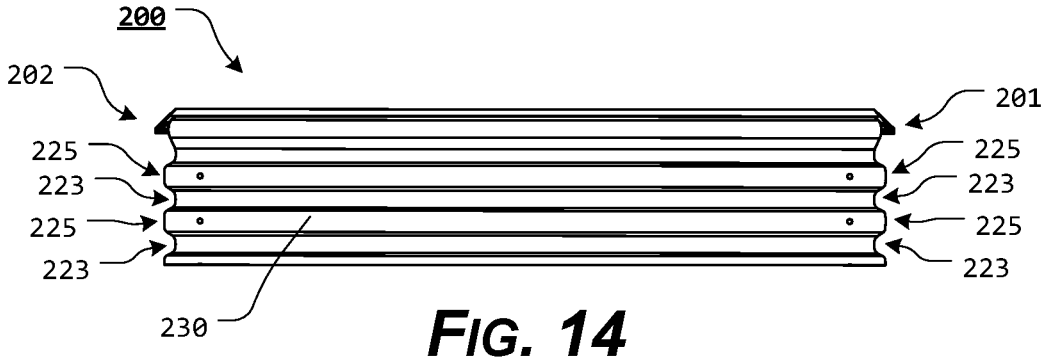
FIG. 14 illustrates a rear view of an exemplary embodiment of a brace element, according to the present disclosure.
Figure 15:
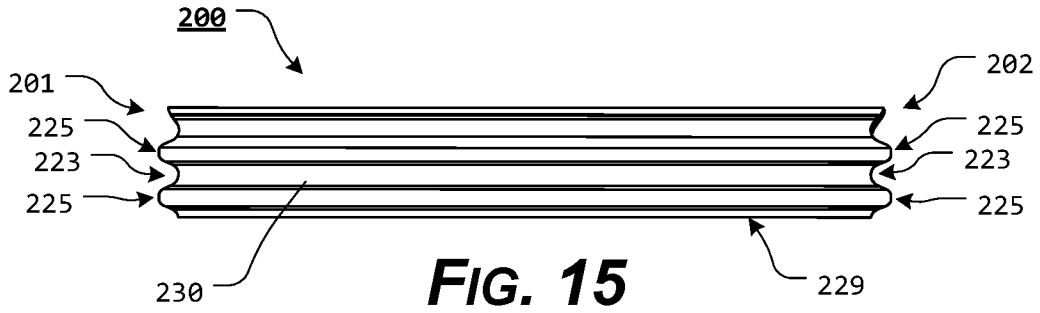
FIG. 15 illustrates a left side view of an exemplary embodiment of a brace element, according to the present disclosure.
Figure 16:
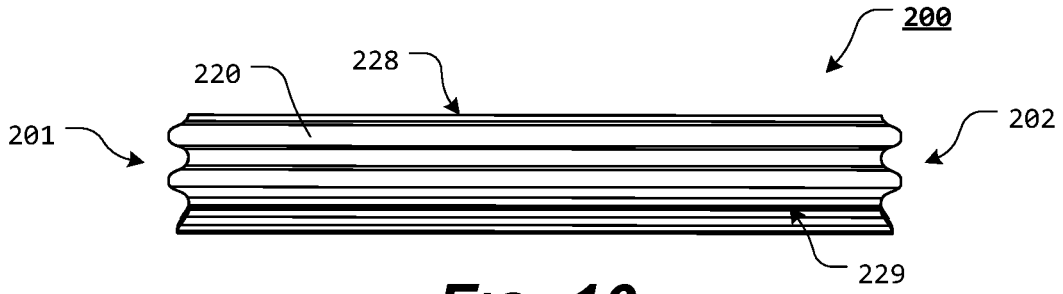
FIG. 16 illustrates a right side view of an exemplary embodiment of a brace element, according to the present disclosure.
Figure 17:
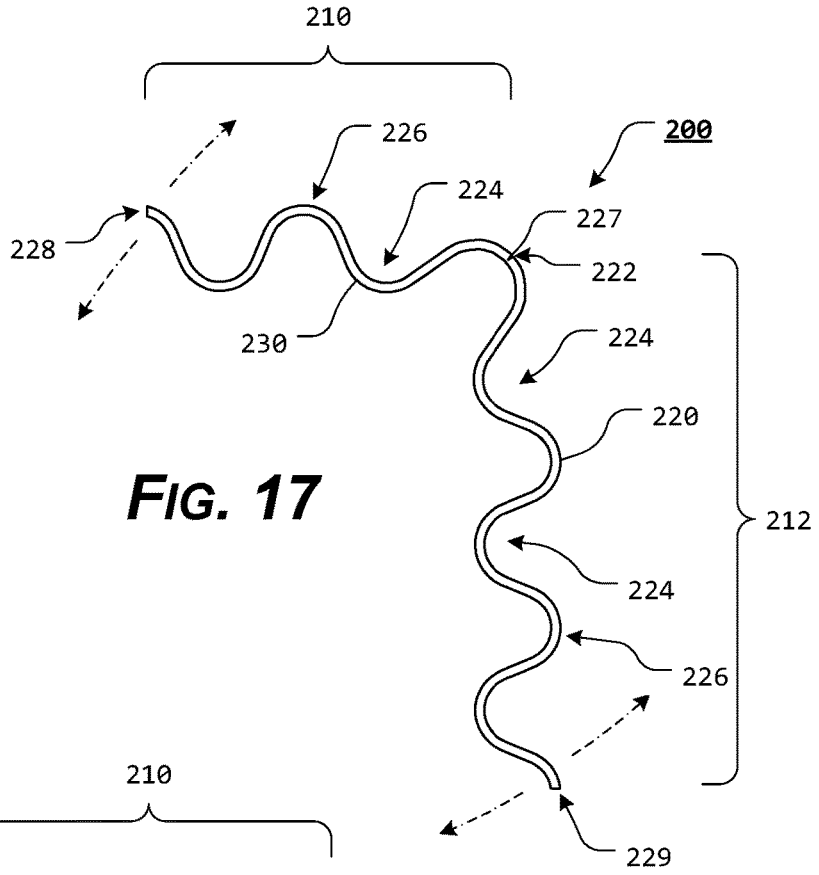
FIG. 17 illustrates a top view of an exemplary embodiment of a brace element in a partially folded position, according to the present disclosure.
Figure 18:
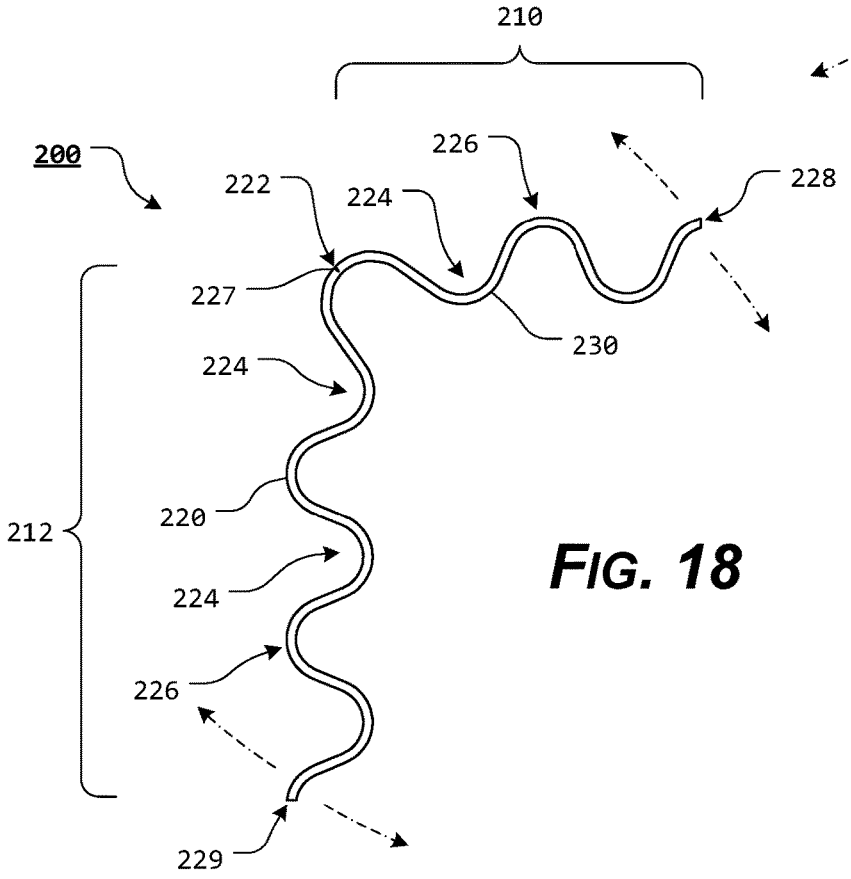
FIG. 18 illustrates a bottom view of an exemplary embodiment of a brace element, according to the present disclosure.
Figure 19:
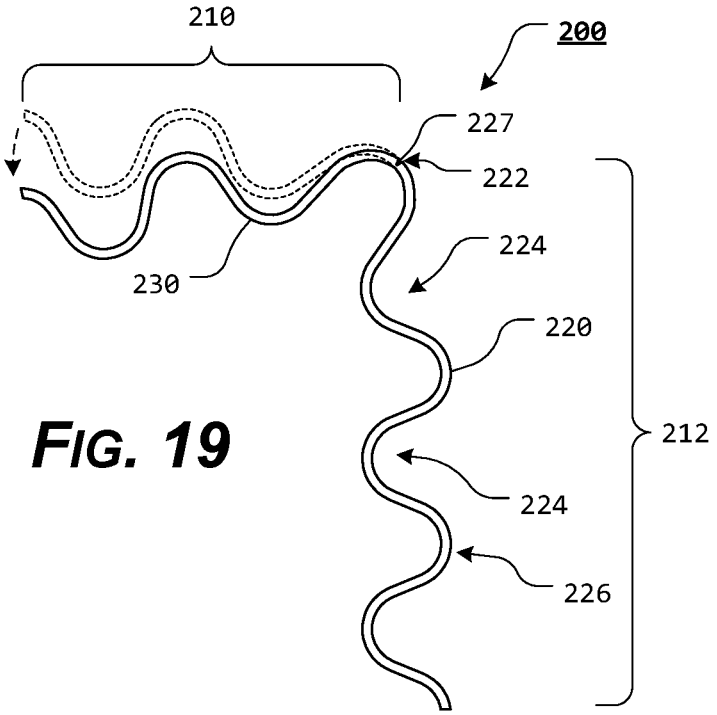
FIG. 19 illustrates a top view of an exemplary embodiment of a brace element in a flexed position, according to the present disclosure.
Figure 20:
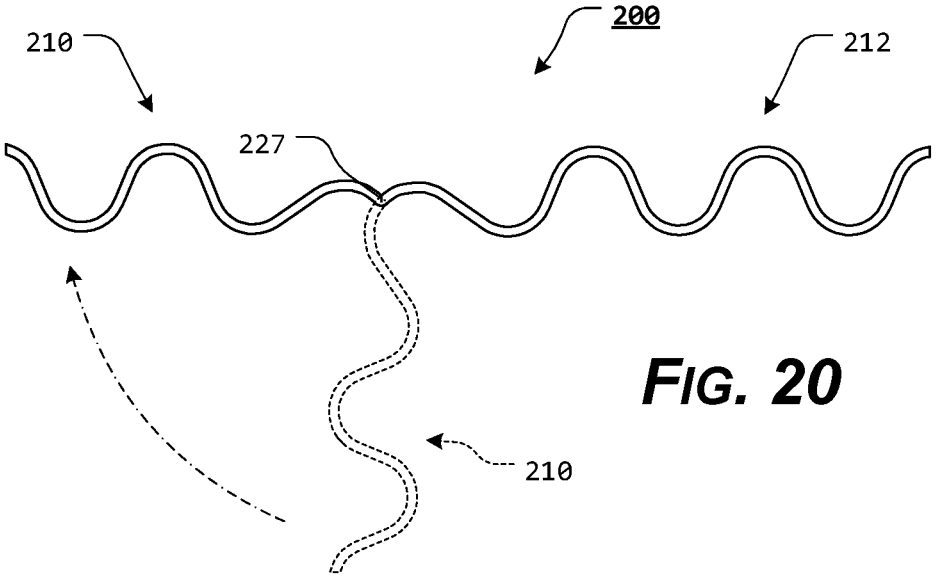
FIG. 20 illustrates a top view of an exemplary embodiment of a brace element, wherein the brace element is in a more flattened position, according to the present disclosure.
Figure 21:
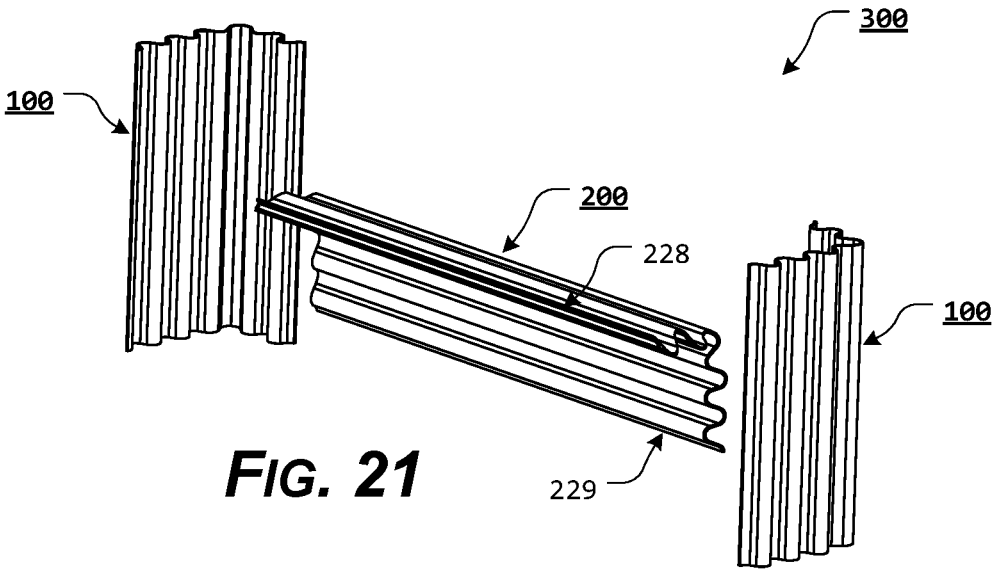
FIG. 21 illustrates an upper, perspective view of exemplary components of a brace element and corner post assembly in an exploded configuration, according to the present disclosure.
Figure 22:
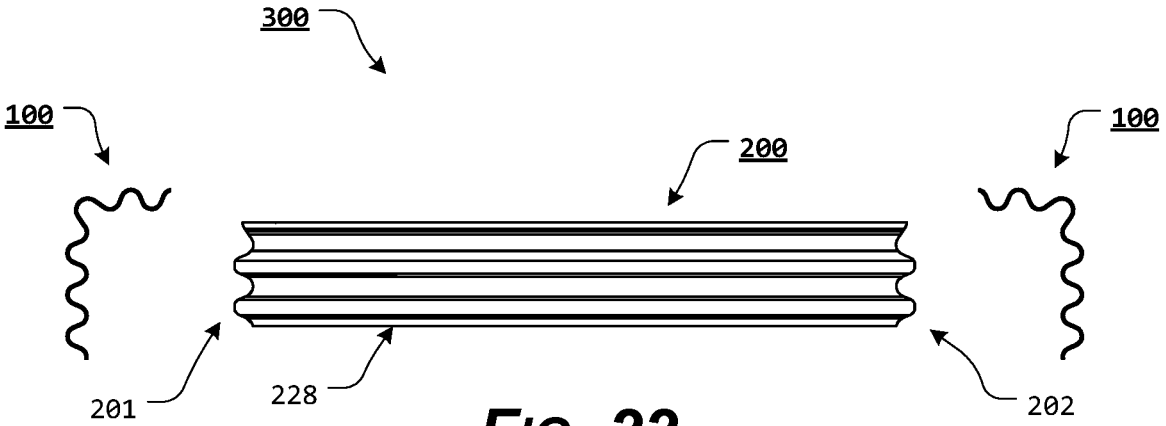
FIG. 22 illustrates a top view of exemplary components of a brace element and corner post assembly in an exploded configuration, according to the present disclosure.
Figure 23:
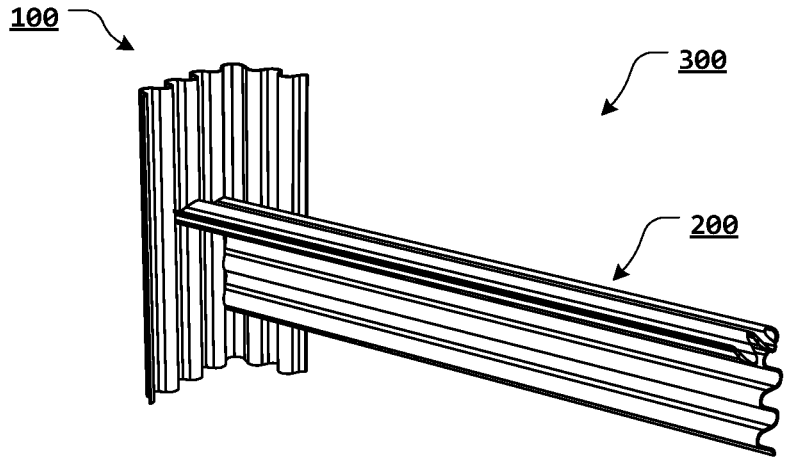
FIG. 23 illustrates an upper, front, perspective view of exemplary components of a brace element aligned with a corner post, illustrating a portion of a brace element and corner post assembly according to the present disclosure.
Figure 24:
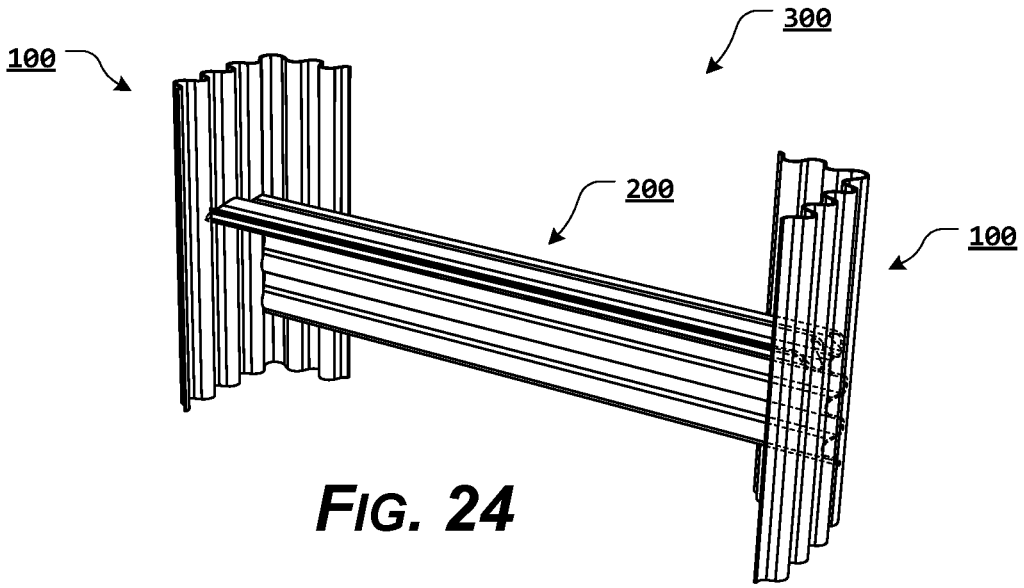
FIG. 24 illustrates an upper, front, perspective view of an exemplary brace element and corner post assembly according to the present disclosure.
Figure 25:
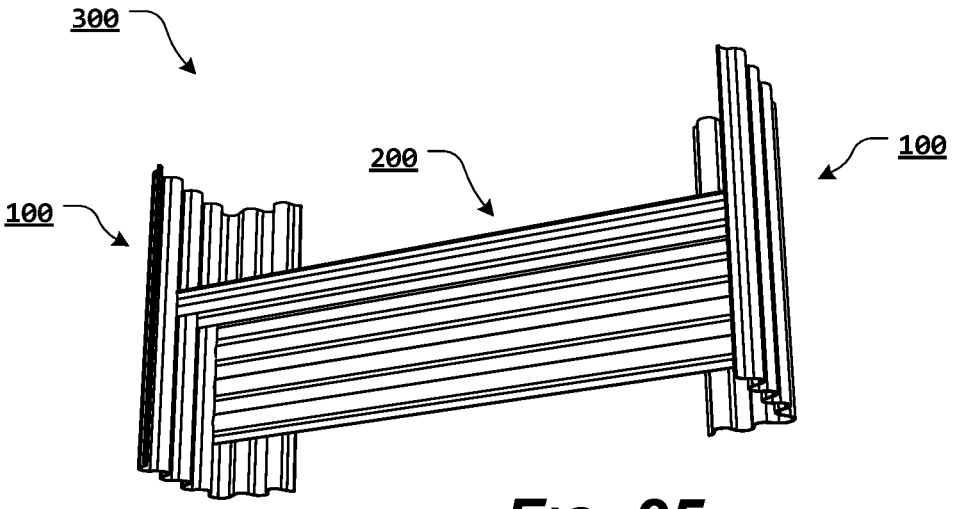
FIG. 25 illustrates a lower, front, perspective view of an exemplary brace element and corner post assembly according to the present disclosure.
Figure 26:
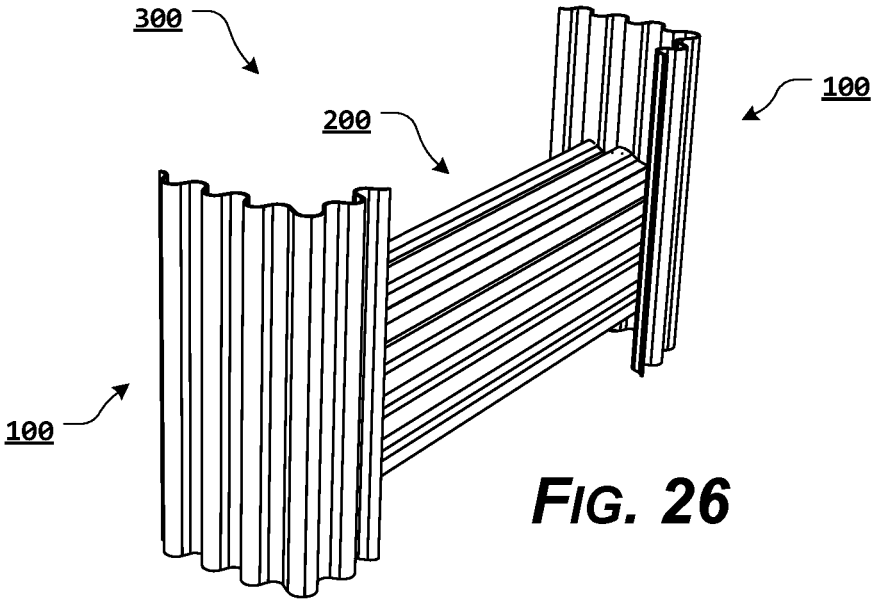
FIG. 26 illustrates an upper, rear, perspective view of an exemplary brace element and corner post assembly according to the present disclosure.
Figure 27:
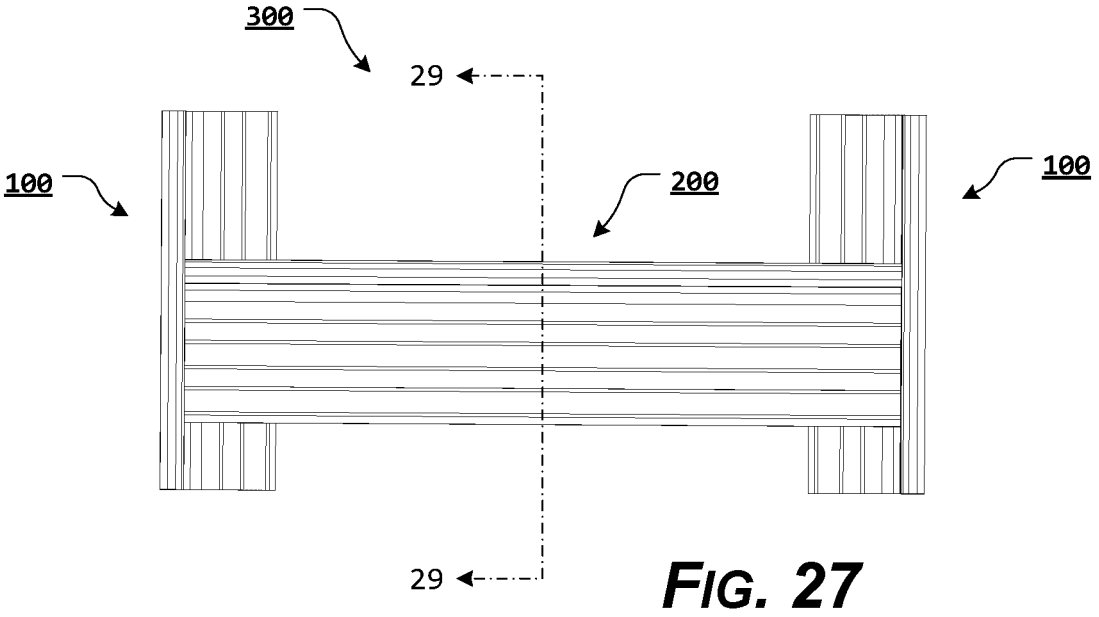
FIG. 27 illustrates a front view of an exemplary brace element and corner post assembly according to the present disclosure.
Figure 28:
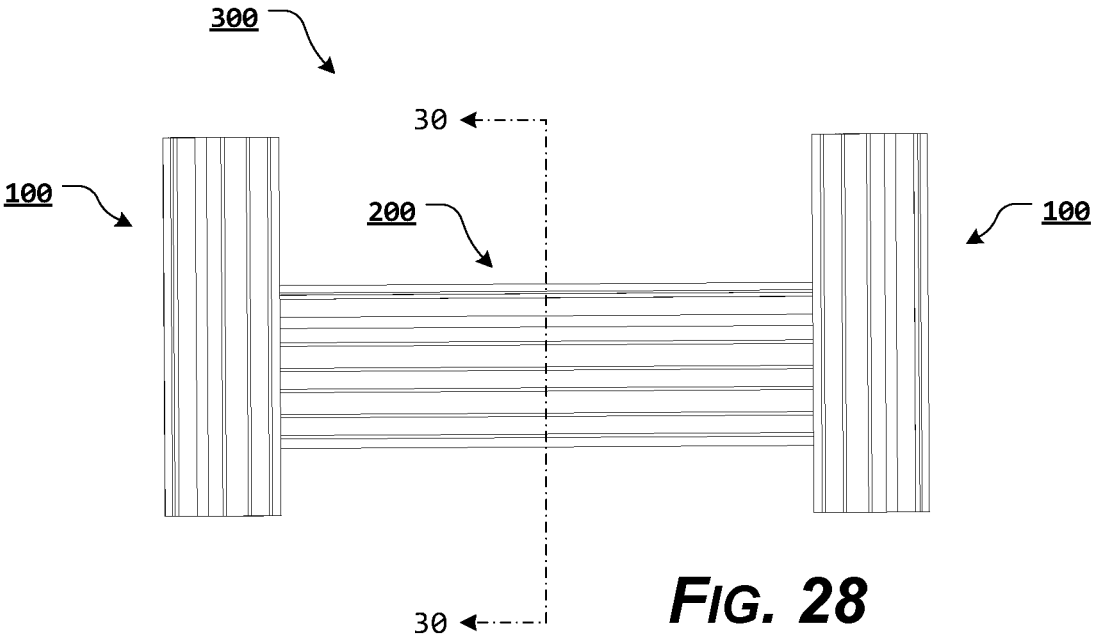
FIG. 28 illustrates a rear view of an exemplary brace element and corner post assembly according to the present disclosure.
Figure 29:
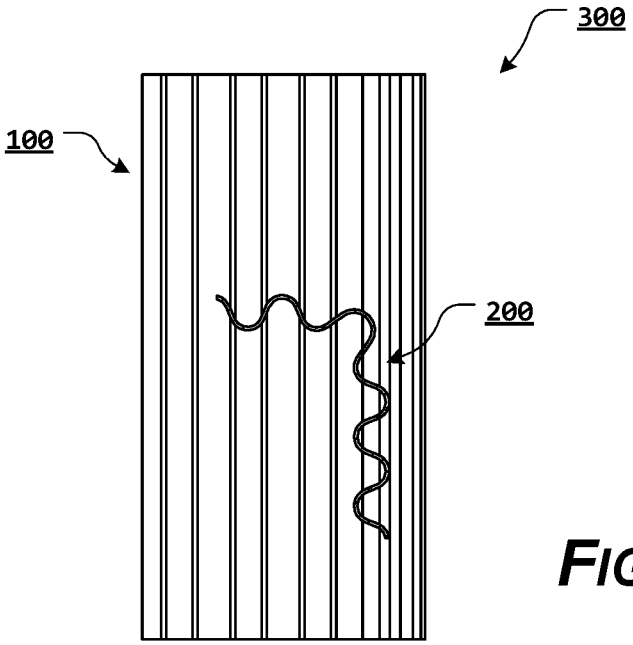
FIG. 29 illustrates a cross-sectional view, taken along line 29-29 of FIG. 27, showing of an exemplary brace element and corner post assembly according to the present disclosure.
Figure 30:
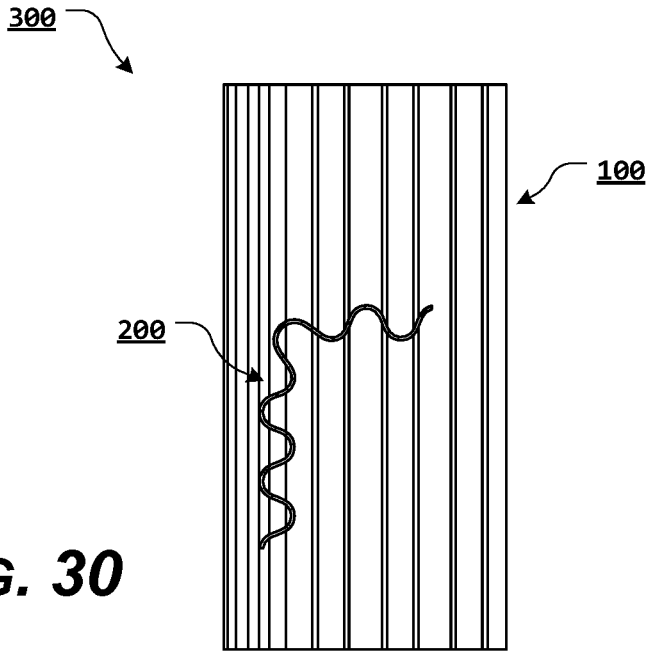
FIG. 30 illustrates a cross-sectional view, taken along line 30-30 of FIG. 28, showing of an exemplary brace element and corner post assembly according to the present disclosure.

By bending or folding the corrugated corner post 100 along the post score mark 127, as illustrated by the semicircular arrows in FIG. 9, a portion of the corrugated corner post 100 can be more easily manipulated to the more flattened position, as illustrated in FIG. 10. In certain embodiments, a plurality of post score marks 127 may be formed at spaced apart locations extending substantially parallel to the longitudinal axis, $A_L$, of the corrugated corner post 100.

By optionally positioning the post score mark 127 proximate the post vertex 122, a single fold of the corrugated corner post 100 can allow the corrugated corner post 100 to be manipulated to a more flattened position. Once in the more flattened position, corrugated corner post 100 can be positioned atop one another and alternating post ridges 126 of a first corrugated corner post 100 can be "nested" within at least a portion of certain alternating post grooves 124 of a second corrugated corner post 100. Thus, the area required for the corrugated corner post 100 is altered, to allow corrugated corner post 100 to be more densely packaged in a particular packaging container.

In certain exemplary embodiments, as illustrated most clearly in FIGS. 1-10, the post score mark 127 may optionally be formed along and parallel to the post vertex 122 of the corrugated corner post 100, as defined between the first post terminal end 101, the second post terminal end 102. Alternatively, the post score mark 127 may optionally be formed in an area other than the post vertex 122.

In various exemplary embodiments, the corrugated corner post 100 is substantially rigid and is formed of cardboard. Alternate materials of construction of the corrugated corner post 100 may include one or more of the following: thick paper (of various types), pasteboard, paperboard, container board, corrugated fiberboard, box board, or chipboard. In still other exemplary embodiments, alternate materials of construction of the corrugated corner post 100 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the corrugated corner post 100 is a design choice based on the desired appearance and functionality of the corrugated corner post 100.

The corrugated corner post 100 may be constructed having an any desired overall size or shape. It should also be understood that the overall size and shape of the corrugated corner post 100, and the various portions thereof, is a design choice based upon the desired functionality, compatibility with desired articles or products and/or appearance of the corrugated corner post 100.

Thus, it should be appreciated that the overall length, width, and/or height of the first corner post leg 110 and the second corner post leg 112 is a design choice, based upon the desired degree of packaging or cushioning provided by the corrugated corner post 100 and/or the size and shape of the packaged article or product with which the corrugated corner post 100 is to be utilized.

In certain exemplary, nonlimiting embodiments, at least a portion of the post outer wall 120 and/or the post inner wall 130 may be textured or may include an adhesive portion to provide a surface or area having a desired degree of friction or adhesive bonding relative to a product or product packaging. Thus, at least a portion of the corrugated corner post 100 may be formed so as to resist movement of the corrugated corner post 100 relative to a surface.

FIGS. 11-20 illustrate certain elements and/or aspects of exemplary embodiments of a brace element 200, according to the present disclosure. As illustrated in FIGS. 11-20, the brace element 200 comprise an elongate portion of material or a sheet 205, extending substantially parallel to a longitudinal axis, $A_L$, from a first brace terminal end 201 to a second brace terminal end 202 and extending substantially parallel to a transverse axis, $A_T$, from a first brace end 228 to a second brace end 229, a brace vertex 222, a first brace leg 210, a second brace leg 212, an brace outer wall 220, an brace inner wall 230, one or more alternating brace ridges 226 and/or brace grooves 224, and an optional brace score mark 227.

It should be appreciated that these elements correspond to and operate similarly to the sheet 105, the first post terminal end 101, the second post terminal end 102, the first corner post end 128, the second corner post end 129, the post vertex 122, the first corner post leg 110, the second corner post leg 112, the post outer wall 120, the post inner wall 130, the one or more alternating post ridges 126 and/or post grooves 124, and the optional post score mark 127, as described herein, with reference to the corrugated corner post 100.

However, as illustrated in FIGS. 11-20, the brace element 200 further includes one or more alternating brace end ridges 225 and brace end grooves 223, formed in the first brace terminal end 201 and the second brace terminal end 202 of both the first brace leg 210 and the second brace leg 212. The alternating brace end ridges 225 and brace end grooves 223 are formed such that when the brace element 200 is aligned with the post inner wall 130 of a corrugated corner post 100, so that the first brace terminal end 201 or the second brace terminal end 202 contact the post inner wall 130 of a corrugated corner post 100, at least a portion of each of the brace end ridges 225 is positioned within at least a portion of a corresponding post ridge 126 and at least a portion of a post groove 124 is positioned within at least a portion of a corresponding brace groove 225.

In certain exemplary embodiments, the alternating brace end ridges 225 and brace end grooves 223 may optionally be formed by making a substantially planar cut, at a determined angle, in the first brace terminal end 201 and the second brace terminal end 202 of the first brace leg 210. Likewise, the alternating brace end ridges 225 and brace end grooves 223 may optionally be formed by making a substantially planar cut, at a determined angle, in the first brace terminal end 201 and the second brace terminal end 202 of the second brace leg 212.

It should be appreciated that the depth of each brace end groove 223 and/or the height of each brace end ridge 225 is dictated by the height of the brace ridges 226 and the depth of the brace grooves 224 with which the brace element 200 is to interact.

As illustrated most clearly in FIGS. 21-30, two corrugated corner posts 100 and one brace element 200 can be assembled to create a brace element and corner post assembly 300. In certain exemplary embodiments, the brace element and corner post assembly 300 is assembled by aligning two corrugated corner posts 100 such that the post inner wall 130 of the first corrugated corner post 100 is facing toward the post inner wall 130 of the second corrugated corner post 100, the longitudinal axis, $A_L$, of the first corrugated corner post 100 is substantially parallel to the longitudinal axis, $A_L$, of the second corrugated corner post 100, and the transverse axis, $A_T$, of the first corrugated corner post 100 is substantially parallel to the transverse axis, $A_T$, of the second corrugated corner post 100.

When the corrugated corner posts 100 are aligned, a brace element 200 is positioned between the aligned corrugated corner posts 100, such that the longitudinal axis, $A_L$, of the brace element 200 is substantially perpendicular to the longitudinal axis, $A_L$, of either or both of the corrugated corner posts 100. The brace element 200 is positioned such that the first brace terminal end 201 contacts the post inner wall 130 of one of the corrugated corner posts 100 and at least a portion of each of the brace end ridges 225 of the first brace leg 210 (of the first brace terminal end 201) is positioned within at least a portion of a corresponding post ridge 126 and at least a portion of a post groove 124 is positioned within at least a portion of a corresponding brace groove 225. Additionally, at least a portion of each of the brace end ridges 225 of the second brace leg 212 is positioned within at least a portion of a corresponding post ridge 126 and at least a portion of a post groove 124 is positioned within at least a portion of a corresponding brace groove 225.

The brace element 200 is also positioned such that the second brace terminal end 202 contacts the post inner wall 130 of the other of the corrugated corner posts 100 and at least a portion of each of the brace end ridges 225 of the first brace leg 210 (of the second brace terminal end 202) is positioned within at least a portion of a corresponding post ridge 126 and at least a portion of a post groove 124 is positioned within at least a portion of a corresponding brace groove 225. Additionally, at least a portion of each of the brace end ridges 225 of the second brace leg 212 is positioned within at least a portion of a corresponding post ridge 126 and at least a portion of a post groove 124 is positioned within at least a portion of a corresponding brace groove 225.

It should be appreciated that the brace element and corner post assembly 300 may be assembled and then positioned within a box or other package. Alternatively, the brace element and corner post assembly 300 may be assembled within a box or other package. Furthermore, the order in which the corrugated corner posts 100 and the brace element 200 are assembled is a design choice. For example, the brace element 200 may be attached to a corrugated corner post 100 and then an additional corrugated corner post 100 may be subsequently positioned relative to the brace element 200.

Once a brace element 200 is appropriately positioned relative to a corrugated corner post 100, the brace element 200 may be maintained in position relative to the corrugated corner post 100 via frictional engagement. Once appropriately positioned, an adhesive or other means may be used to maintain the position of the brace element 200 relative to the corrugated corner post(s) 100.

Once appropriately positioned, the brace element 200 resists any compressional force that would urge the corrugated corner posts 100 toward one another.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A corner post assembly, comprising:

a corrugated corner post, comprising:

a portion of material extending continuously, substantially parallel to a longitudinal axis of said corrugated corner post, from a first post terminal end to a second post terminal end, wherein said portion of material extends continuously, substantially perpendicular to said longitudinal axis of said corrugated corner post, from a first corner post end to a second corner post end;

a post vertex extending substantially parallel to said longitudinal axis of said corrugated corner post;

a first corner post leg, extending laterally from said post vertex, said first corner post leg having one or more alternating post ridges and post grooves, each of said alternating post ridges and post grooves of said first corner post leg extending substantially parallel to said longitudinal axis of said corrugated corner post;

a second corner post leg, extending laterally from said post vertex and away from said first corner post leg, said second corner post leg having one or more alternating post ridges and post grooves, each of said alternating post ridges and post grooves of said second corner post leg extending substantially parallel to said longitudinal axis of said corrugated corner post;

a post score mark formed in said corrugated corner post, extending substantially parallel to said longitudinal axis of said corrugated corner post, wherein said post score mark provides a line or portion along which said corrugated corner post may be bent or folded such that said corrugated corner post may be more easily manipulated to a more flattened position a brace element, comprising:

a portion of material extending continuously, substantially parallel to a longitudinal axis of said brace element, from a first brace terminal end to a second brace terminal end, wherein said portion of material extends continuously, substantially perpendicular to said longitudinal axis of said brace element, from a first brace end to a second brace end;

a brace vertex extending substantially parallel to said longitudinal axis of said brace element;

a first brace leg, extending laterally from said brace vertex, said first brace leg having one or more alternating brace ridges and brace grooves, each of said alternating brace ridges and brace grooves of said first brace leg extending substantially parallel to said longitudinal axis of said brace element;

a second brace leg, extending laterally from said brace vertex and away from said first brace leg, said second brace leg having one or more alternating brace ridges and brace grooves, each of said alternating brace ridges and brace grooves of said second brace leg extending substantially parallel to said longitudinal axis of said brace element;

one or more alternating brace end ridges and brace end grooves formed in said first brace terminal end and said second brace terminal end of said first brace leg and said second brace leg; and a brace score mark formed in said brace element, extending substantially parallel to said longitudinal axis of said brace element, wherein said brace score mark provides a line or portion along which said brace element may be bent or folded such that said brace element may be more easily manipulated to a more flattened position;

wherein two said corrugated corner posts are aligned and said brace element being positioned between said aligned corrugated corner posts, such that at least a portion of each of said brace end ridges of said first brace leg is positioned within at least a portion of a corresponding post ridge and at least a portion of a post groove is positioned within at least a portion of a corresponding brace groove, and wherein at least a portion of each of said brace end ridges of said second brace leg is positioned within at least a portion of a corresponding post ridge and at least a portion of a post groove is positioned within at least a portion of a corresponding brace groove.

2. The corner post assembly of claim 1, wherein said portion of material is a sheet material.

3. The corner post assembly of claim 1, wherein said post score mark is formed proximate a center of said corrugated corner post, as defined between said first corner post end and said second corner post end.

4. The corner post assembly of claim 1, wherein said post score mark is formed proximate said first corner post end or said second corner post end.

5. The corner post assembly of claim 1, wherein an outer wall of said corrugated corner post is substantially coextensive with an inner wall of said corrugated corner post.

6. The corner post assembly of claim 1, wherein each of said alternating post ridges and post grooves of said first corner post leg are alternating post ridges and post grooves, extending substantially parallel to said post vertex and wherein each of said alternating post ridges and post grooves of said second corner post leg are alternating post ridges and post grooves, extending substantially parallel to said post vertex.

7. The corner post assembly of claim 1, wherein said first corner post leg and said second corner post leg are each curvilinear along a respective length.

8. The corner post assembly of claim 1, wherein a transverse cross-section of said first corner post leg forms a mirror image of a transverse cross-section of said second corner post leg.

9. The corner post assembly of claim 1, wherein said post score mark is formed in a portion of an outer wall or exterior surface of said portion of material.

10. The corner post assembly of claim 1, wherein said brace score mark is formed proximate a center of said brace, as defined between said first brace end and said second brace end.

11. The corner post assembly of claim 1, wherein said brace score mark is formed proximate said first brace end or said second brace end.

12. The corner post assembly of claim 1, wherein an outer wall of said brace is substantially coextensive with an inner wall of said brace.

13. The corner post assembly of claim 1, wherein each of said alternating brace ridges and brace grooves of said first brace leg are alternating brace ridges and brace grooves, extending substantially parallel to said brace vertex and wherein each of said alternating brace ridges and brace grooves of said second brace leg are alternating brace ridges and brace grooves, extending substantially parallel to said brace vertex.

14. The corner post assembly of claim 1, wherein said first brace leg and said second brace leg are each curvilinear along a respective length.

15. The corner post assembly of claim 1, wherein an inner wall of said first brace leg and an inner wall of said second brace leg comprises a sinusoidal succession of waves or curves.

16. The corner post assembly of claim 1, wherein a transverse cross-section of said first brace leg forms a mirror image of a transverse cross-section of said second brace leg.

17. The corner post assembly of claim 1, wherein said brace score mark is formed in a portion of an outer wall or exterior surface of said portion of material.

18. A corner post assembly, comprising:

a corrugated corner post, comprising:

a portion of material extending continuously, substantially parallel to a longitudinal axis of said corrugated corner post, from a first post terminal end to a second post terminal end, wherein said portion of material extends continuously, substantially perpendicular to said longitudinal axis of said corrugated corner post, from a first corner post end to a second corner post end;

a post vertex extending substantially parallel to said longitudinal axis of said corrugated corner post;

a first corner post leg, extending laterally from said post vertex, said first corner post leg having one or more alternating post ridges and post grooves, each of said alternating post ridges and post grooves of said first corner post leg extending substantially parallel to said longitudinal axis of said corrugated corner post;

a second corner post leg, extending laterally from said post vertex and away from said first corner post leg, said second corner post leg having one or more alternating post ridges and post grooves, each of said alternating post ridges and post grooves of said second corner post leg extending substantially parallel to said longitudinal axis of said corrugated corner post;

a brace element, comprising:

a portion of material extending continuously, substantially parallel to a longitudinal axis of said brace element, from a first brace terminal end to a second brace terminal end, wherein said portion of material extends continuously, substantially perpendicular to said longitudinal axis of said brace element, from a first brace end to a second brace end;

a brace vertex extending substantially parallel to said longitudinal axis of said brace element;

a first brace leg, extending laterally from said brace vertex, said first brace leg having one or more alternating brace ridges and brace grooves, each of said alternating brace ridges and brace grooves of said first brace leg extending substantially parallel to said longitudinal axis of said brace element;

a second brace leg, extending laterally from said brace vertex and away from said first brace leg, said second brace leg having one or more alternating brace ridges and brace grooves, each of said alternating brace ridges and brace grooves of said second brace leg extending substantially parallel to said longitudinal axis of said brace element; and one or more alternating brace end ridges and brace end grooves formed in said first brace terminal end and said second brace terminal end of said first brace leg and said second brace leg;

wherein two said corrugated corner posts are aligned and said brace element being positioned between said aligned corrugated corner posts, such that at least a portion of each of said brace end ridges of said first brace leg is positioned within at least a portion of a corresponding post ridge and at least a portion of a post groove is positioned within at least a portion of a corresponding brace groove, and wherein at least a portion of each of said brace end ridges of said second brace leg is positioned within at least a portion of a corresponding post ridge and at least a portion of a post groove is positioned within at least a portion of a corresponding brace groove.

19. A corner post assembly, comprising:

a corrugated corner post, comprising:

a portion of material extending from a first post terminal end to a second post terminal end, wherein said portion of material extends continuously, substantially perpendicular to a longitudinal axis of said corrugated corner post, from a first corner post end to a second corner post end;

a post vertex extending substantially parallel to said longitudinal axis of said corrugated corner post;

a first corner post leg, extending from said post vertex, said first corner post leg having one or more alternating post ridges and post grooves, each of said alternating post ridges and post grooves of said first corner post leg extending substantially parallel to said longitudinal axis of said corrugated corner post;

a second corner post leg, extending from said post vertex, away from said first corner post leg, said second corner post leg having one or more alternating post ridges and post grooves, each of said alternating post ridges and post grooves of said second corner post leg extending substantially parallel to said longitudinal axis of said corrugated corner post;

a brace element, comprising:

a portion of material extending from a first brace terminal end to a second brace terminal end, wherein said portion of material extends continuously, substantially perpendicular to a longitudinal axis of said brace element, from a first brace end to a second brace end;

a brace vertex extending substantially parallel to said longitudinal axis of said brace element;

a first brace leg, extending from said brace vertex, said first brace leg having one or more alternating brace ridges and brace grooves, each of said alternating brace ridges and brace grooves of said first brace leg extending substantially parallel to said longitudinal axis of said brace element;

a second brace leg, extending from said brace vertex, away from said first brace leg, said second brace leg having one or more alternating brace ridges and brace grooves, each of said alternating brace ridges and brace grooves of said second brace leg extending substantially parallel to said longitudinal axis of said brace element; and one or more alternating brace end ridges and brace end grooves formed in said first brace terminal end and said second brace terminal end of said first brace leg and said second brace leg.

20. The corner post assembly of claim 19, wherein two said corrugated corner posts are aligned and said brace element being positioned between said aligned corrugated corner posts, such that at least a portion of each of said brace end ridges of said first brace leg is positioned within at least a portion of a corresponding post ridge and at least a portion of a post groove is positioned within at least a portion of a corresponding brace groove, and wherein at least a portion of each of said brace end ridges of said second brace leg is positioned within at least a portion of a corresponding post ridge and at least a portion of a post groove is positioned within at least a portion of a corresponding brace groove.

* * * * *